US008069495B2

(12) United States Patent
Kemper

(10) Patent No.: US 8,069,495 B2
(45) Date of Patent: Dec. 6, 2011

(54) WEARABLE PROTECTIVE BARRIER WITH DETACHABLE HAND AND INSTRUMENT COVERS

(75) Inventor: Alicia Kemper, Gainesville, FL (US)

(73) Assignee: Covies, Inc., Gainesville, FL (US)

( * ) Notice: Subject to any disclaimer, the term of this patent is extended or adjusted under 35 U.S.C. 154(b) by 442 days.

(21) Appl. No.: 12/211,531

(22) Filed: Sep. 16, 2008

(65) Prior Publication Data

US 2010/0064408 A1 Mar. 18, 2010

(51) Int. Cl.
*A41D 13/12* (2006.01)

(52) U.S. Cl. ..... 2/51

(58) Field of Classification Search ..... 2/114, 51, 2/247, 94, 104, 69, 108, 456, 250–253, 901, 2/46, 158, 159, 161.7, 48, 243.1; 224/660; 128/852

See application file for complete search history.

(56) References Cited

U.S. PATENT DOCUMENTS

| | | | | |
|---|---|---|---|---|
| 3,428,962 | A * | 2/1969 | Slimovitz | 2/48 |
| 3,589,595 | A * | 6/1971 | White | 383/11 |
| 4,171,542 | A | 10/1979 | Cox et al. | |
| 4,791,681 | A * | 12/1988 | Dean | 2/106 |
| 5,054,127 | A * | 10/1991 | Zevchak | 2/247 |
| 5,351,008 | A | 9/1994 | Leach et al. | |
| 5,414,867 | A * | 5/1995 | Bowling et al. | 2/51 |
| 5,466,898 | A * | 11/1995 | Gilbert et al. | 181/131 |
| 5,483,701 | A * | 1/1996 | Ferreyros | 2/49.2 |
| 5,549,388 | A * | 8/1996 | Wilkes | 383/84 |
| 5,799,336 | A * | 9/1998 | Cooper | 2/247 |
| 5,878,439 | A * | 3/1999 | Waters, Jr. | 2/161.6 |
| 6,079,049 | A * | 6/2000 | Moir | 2/69 |
| 6,308,875 | B1 * | 10/2001 | Almo | 224/660 |
| 6,817,032 | B2 * | 11/2004 | Hollander | 2/69 |
| 7,073,204 | B1 | 7/2006 | Boyles | |
| 7,181,773 | B1 | 2/2007 | Piraka | |
| 7,197,771 | B2 | 4/2007 | Hollander | |
| 7,296,652 | B1 | 11/2007 | Rosenberg | |
| D576,379 | S * | 9/2008 | Najarian | D2/864 |
| 7,549,179 | B1 * | 6/2009 | Saied | 2/51 |
| 7,647,648 | B2 * | 1/2010 | Komorowski | 2/51 |
| 7,684,562 | B1 * | 3/2010 | Wilson | 379/452 |
| 2007/0267026 | A1 | 11/2007 | Grant-Jennings | |
| 2008/0312615 | A1 * | 12/2008 | Hunter | 604/345 |
| 2009/0165186 | A1 * | 7/2009 | Mijares et al. | 2/83 |

FOREIGN PATENT DOCUMENTS

| | | |
|---|---|---|
| JP | 2001-064808 | 3/2001 |
| KR | 2004-034935 | 4/2004 |

* cited by examiner

*Primary Examiner* — Amy Vanatta
(74) *Attorney, Agent, or Firm* — Saliwanchik Lloyd & Eisenschenk

(57) ABSTRACT

A wearable, protective barrier comprising a garment having removably attached covers to protect hands and/or instruments placed therein. The covers can be removably affixed to various locations on the garment that would allow them to be detached from the garment before or after insertion of a hand. Various tabs located on the covers aid in inserting and adjusting the covers on the hand and/or instrument. In a specific embodiment, the covers and/or garment comprise one or more heat sensitive materials, such that some portion of a cover can be temporarily heat-sealed to the garment for later removal. In a further embodiment, the garment and covers are sterile and disposable.

47 Claims, 10 Drawing Sheets

WEARABLE PROTECTIVE BARRIER WITH DETACHABLE HAND AND INSTRUMENT COVERS

BACKGROUND OF INVENTION

To protect the safety of patients and staff, there is an ongoing need in hospitals to control the spread of transmissible diseases. There are a variety of procedures and devices utilized reduce or eliminate the spread of contagion within hospitals, clinics, doctors' offices, and other patient care facilities. Of particular concern is the control of disease spread from within hospital isolation rooms. Patients in isolation rooms are constantly producing transmissible organisms that can be spread by coughing, sneezing, talking, and by contact with people or equipment. Doctors, nurses, technicians and other hospital staff are often required to enter isolation rooms in order to tend to patients and are usually enrobed in protective clothing, such as gown, gloves, hats, booties, and masks to ensure that transmissible organisms are not transmitted to or from the patient.

There are also a multitude of instruments that may be used during examination of a patient. Some of these instruments may reside in the room, others may be removed after completion of an examination. While many of the instruments removed from an isolation room are amenable to sterilization, others are not. For example, many doctors, nurses, and other medical staff often have personal, preferred stethoscopes, or other hand held devices, that they use when examining patients. But, many stethoscopes and other types of devices cannot be quickly sterilized by standard procedures, if at all. Thus, medical professionals often do not use their own comfortable, familiar devices in isolation rooms, to avoid contamination. This can lessen the accuracy of an examination because professionals are forced to use unfamiliar devices, or devices that may be of inferior quality.

There are several different kinds of covers known in art that can be used to protect a person's hands or for covering medical devices. For example, U.S. Pat. Nos. 4,171,542 and 7,073,204 describe medical gowns with enclosures for protecting hands or devices. U.S. Published Application No. 2007/0267026 discloses a cover for medical instruments. However, these covers tend to be difficult and time-consuming to use, or can restrict movement. Often, they are difficult or time-consuming to remove without contaminating the user or the instrument.

BRIEF SUMMARY

The subject invention provides a wearable protective barrier, which is in general a garment, such as a gown, apron, bib, pants, or shirt with removably attached covers for one or more hands and/or medical devices. The covers can be configured to accommodate a person's hand either alone or while holding a medical device. The covers can be positioned on the outside of a garment, so that the hand(s) can be easily inserted, either alone or while holding a device. Once the hand(s) and/or medical device is positioned within a cover, it can be easily removed from the garment. Multiple covers can be attached to the garment and oriented to facilitate access from different angles. In an alternative embodiment, covers of the subject invention are not attached to a garment, but rather can be utilized separately from a garment.

In further embodiments, the covers can have one or more tabs to aid in inserting and/or adjusting hands and/or devices in the cover. There can also be one or more divisions or compartments to separately accommodate the thumb and/or fingers. To aid in holding the cover(s) on the hand or arm, there can also be gathers, puckers, elastic, or other structures on or within the covers that can constrict the cover at one or more locations at one or more locations around the wrist or arm to hold it in position. Alternatively, a cover can make use of a crepe or crepe-like material for all or part of its construction, so that the cover can or be made to at least partially conform to or be made to the shape of a hand and/or device within.

A cover of the subject invention provides a quick and easy way to protect a person's hand and/or a medical device. The covers can also be used to protect a persons hand(s) while they are holding a medical device, thus, protecting both the hand and the medical device. The covers are designed to be easy to put on and to remove without risk of contamination of either the user or the medical device.

BRIEF DESCRIPTION OF DRAWINGS

In order that a more precise understanding of the above recited invention be obtained, a more particular description of the invention briefly described above will be rendered by reference to specific embodiments thereof that are illustrated in the appended drawings. Understanding that these drawings depict only typical embodiments of the invention and are not therefore to be considered as limiting in scope, the invention will be described and explained with additional specificity and detail through the use of the accompanying drawings in which:

FIG. 2C illustrates an embodiment having an end pleat at the closed end.

FIGS. 3A and 3B illustrate a cover embodiment having a separate compartment or division to accommodate the thumb of a wearer, as well as a tapered closed end to better conform to the shape of a hand. FIG. 3C illustrates a cover embodiment that is compressed lengthwise and the dashed lines represent a removably affixed support structure that can also be utilized with the compressed cover. FIG. 3D illustrates a cover embodiment utilizing a cuff. Also shown, are examples of fold locations that can minimize the overall size of a cover attached to a garment.

DETAILED DISCLOSURE

The subject application in general describes embodiments of a wearable protective barrier. More specifically, the subject invention pertains to a garment having removably affixed thereto at least one cover capable of containing a user's hand and/or a medical device. Still more specifically, the subject application provides a disposable garment having at least one removably attached cover capable of containing a user's hand while holding a medical device. In further embodiments, the garments and/or covers of the subject invention can be sterile.

The following description will disclose that the subject invention is particularly useful in the field of medical or surgical environments, particularly in isolation or clean room environments, to inhibit the spread of diseases. However, a person with skill in the art will readily recognize numerous other uses that would be applicable to the devices and methods of the subject invention. While the subject application describes hand and device covers to prevent the spread of contagion in a hospital or medical environment, other modifications or uses apparent to a person with skill in the art and having benefit of the subject disclosure are contemplated to be within the scope of the present invention.

The terms "garment" or "gown" as used in the subject application are merely for literary convenience. The terms should not be construed as limiting in any way. The wearable protective barrier of the subject invention could include any garment to which one or more covers described herein could be attached. This can include such wearable garments as gowns, shirts, dresses, aprons, bibs, bandoliers, suspenders, vests, pants, chaps, and leg clothing, and the like, including any combinations or variations thereof, which are capable of protecting at least a portion of the front side of a wearer. Further, the devices, apparatuses, methods, techniques and/or procedures of the subject invention could be utilized by any person desiring or needing to do so and having the necessary skill and understanding of the invention.

The present invention is more particularly described in the following examples that are intended to be illustrative only, since numerous modifications and variations therein will be apparent to those skilled in the art. As used in the specification and in the claims, the singular for "a," "an" and "the" include plural referents unless the context clearly dictates otherwise.

Figure 1:
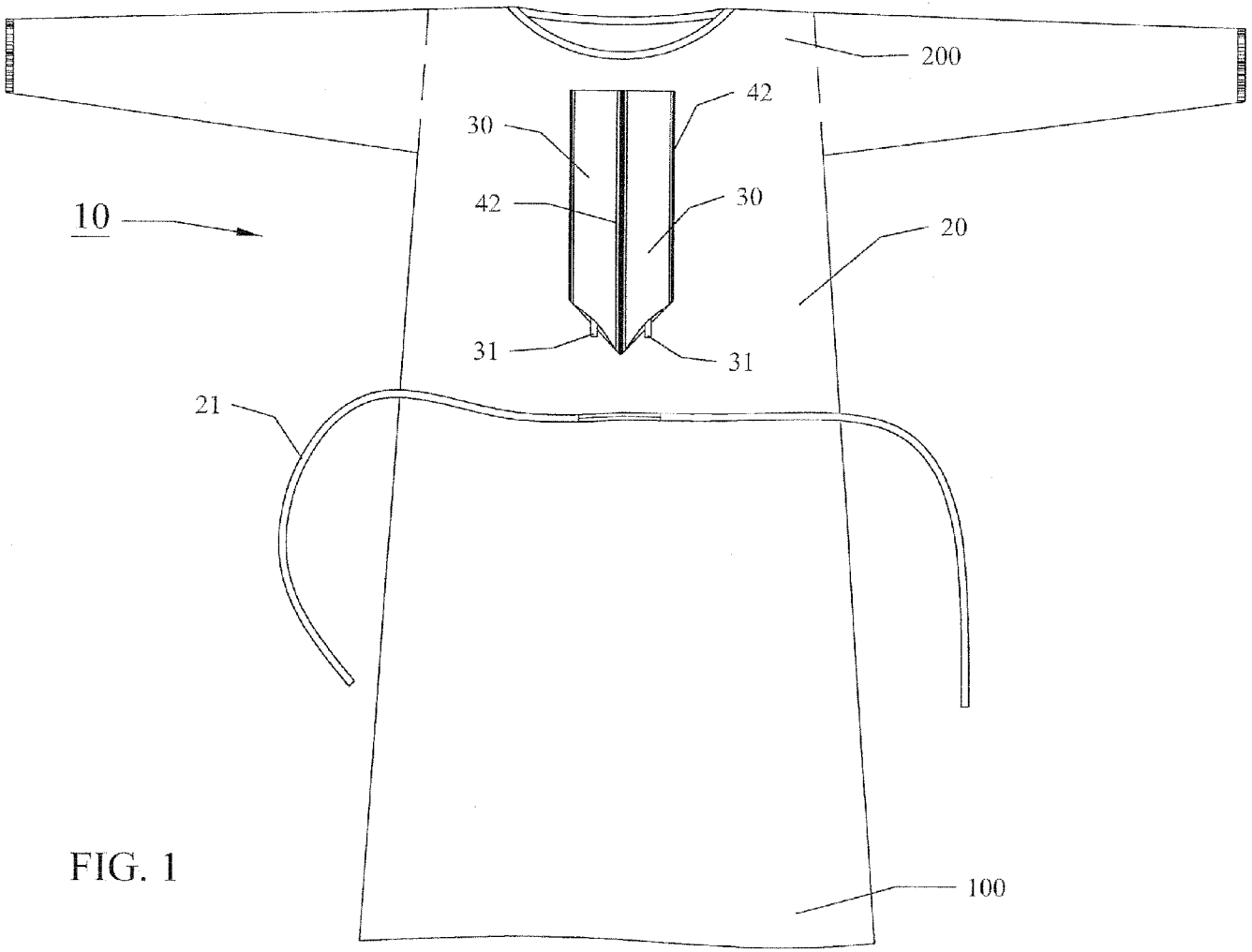
FIG. 1 illustrates one embodiment of the wearable protective barrier of the subject invention. In this embodiment, a garment can be configured with two removable covers attached vertically to the chest area, such that the open end is directed towards the bottom of the garment.
Figure 9:
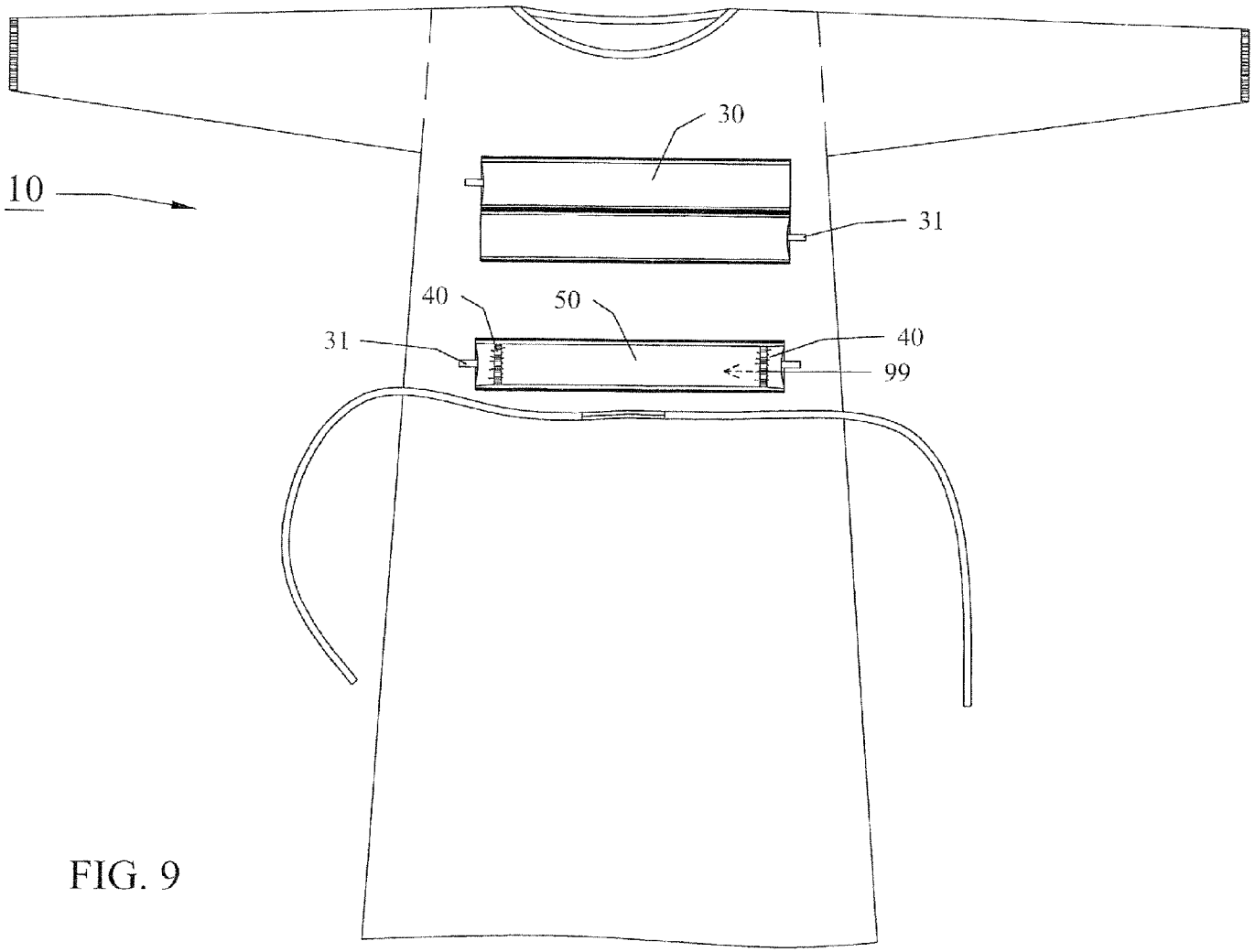
FIG. 9 illustrates an embodiment of a wearable protective barrier of the subject invention wherein a garment can be configured with a covering for two hands removably attached to the front of the garment.
Figure 10B:
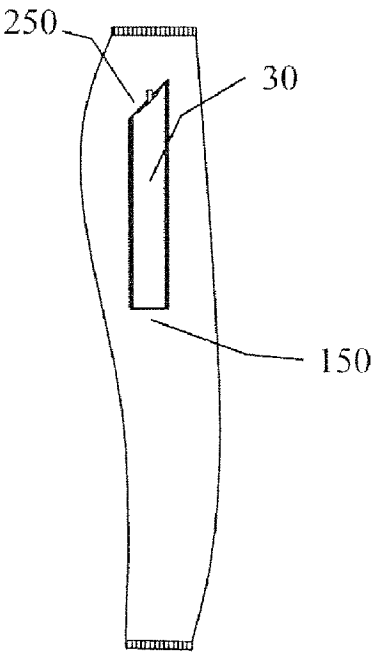
FIGS. 10A and 10B illustrate an alternative embodiment of a wearable protective barrier, which is pants or a pants-like garment. Shown are various locations where covers of the subject invention can be attached.
Figure 10A:
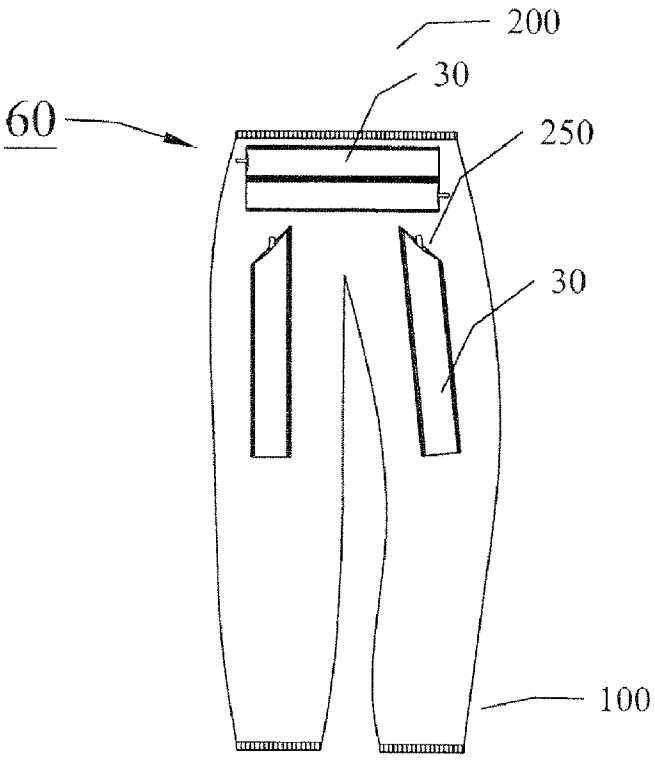

With reference to the attached figures, which show certain embodiments of the subject invention, it can be seen that the subject invention comprises, in general, a wearable protective barrier 10 comprising a wearable garment 20 with one or more detachable hand and/or device covers 30. FIG. 1 illustrates one representative example of a protective barrier 10 of the subject invention. FIGS. 9, 10A, and 10B illustrate alternative examples of protective barriers with attached covers that can be used with the subject invention.

A cover 30, according to the subject invention, can comprise any of a variety of materials. Preferably, a cover comprises one or more materials suitable for the environment or situation in which they will be used, such as, by way of non-limiting examples, cotton, rayon, lycra, acrylic, polyester, paper, wool, linen, silk, rubber, plastic, polyvinylpyrrolidones, polyvinylpropylenes, polypropylenes, polyethylenes, or any other suitable material(s) known in the art. For example, they can comprise one or more barrier-type materials or substances that can be sterilized and/or can prevent the passage of microorganisms, fluids, gases, or other substances. In one embodiment, a laminate material, such as, for example, a non-woven polyester adhered to a layer of high density polyethylene (TYVEK®) or a polyethylene-coated polypropylene, or similar barrier materials can be used for manufacturing a cover. Preferably, the material(s) of a cover are pliable enough so that the cover does not unduly restrict a person's hand or an instrument therein. Alternatively, the material of the covers can be a few microns in thickness, so that they are sufficiently pliable, but able to provide adequate barrier protection.

In a further embodiment, a cover can comprise more than one material, such that, for example, two or more sides or sections of a cover can comprise different materials. In one embodiment, a first side 11 of a cover can comprise a shape conforming material, such as for example, a creped, pleated, gathered, or other shape-conforming material that can be pulled over a hand or device and will conform, at least partially, to the shape of the hand and/or device and aid in holding the cover on a hand or instrument, and the second, or opposite, side 12 can comprise a material that facilitates attachment to the wearable garment 20. In a specific embodiment, one or more crepe materials or other light-weight crinkled, crisped, or frizzled fabrics, woven or non-woven from any of various fibers or materials, can be used for all or a portion of a first side 11 of a cover. In a further embodiment, the crepe material can be conformed, at least partially, to the shape of a hand or arm and/or device within a cover by pulling, tugging, pressing, pinching, or otherwise deforming the fabric structure. There are a multitude of crepe or crepe-like materials that a person with skill in the art would readily recognize as appropriate for the various uses to which a cover and garment of the subject invention can be utilized and such alternatives are contemplated to be within the scope of the subject invention.

Figure 2A:
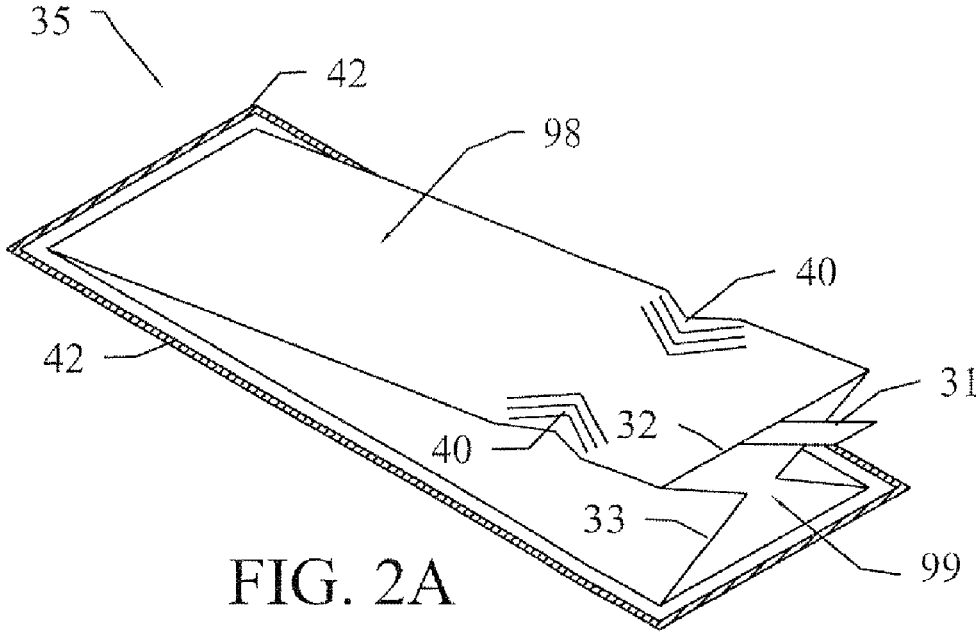
FIGS. 2A, 2B and 2C illustrate an embodiment of a cover of the subject invention having lengthwise pleats and crosswise folds, as well as securing structures on one side.
Figure 2B:
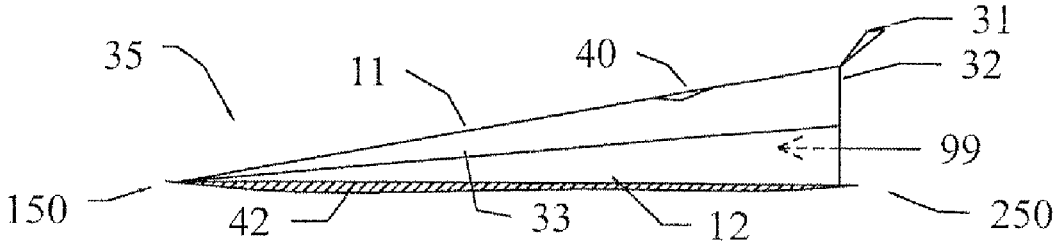

The shape and configuration of the covers 30 can also vary depending upon expected use. For example, FIGS. 2A and 2B illustrate an embodiment of a sheath-like cover 35. This embodiment can permit quick insertion of a wearer's hand and/or an instrument, if necessary. Another embodiment, shown for example in FIGS. 3A and 3B employs a mitten-like cover 37, having a separate thumb compartment 38, which can aid in grasping or holding. In this embodiment, the hand of a wearer can be quickly inserted into the cover 30, with or without an instrument, and the thumb compartment used, if necessary. Further embodiments can utilize additional divisions or compartments for one or more fingers. In another embodiment, the covers can be variously tapered or shaped towards the closed end to further accommodate the shape of a hand or arm. FIG. 3A illustrates an embodiment where the closed end is slightly tapered to conform to the shape of fingers.

In addition, to facilitate grasping and holding of objects with the covers of the subject invention, all or some portion of the exterior surface, can comprise any of a multitude of textured surfaces, such as raised ribs, dots, or other shapes.

Alternatively, all or some portion of the exterior surface can be covered with an easily releasable tacky, sticky, or semi-adhesive material.

Figure 11:
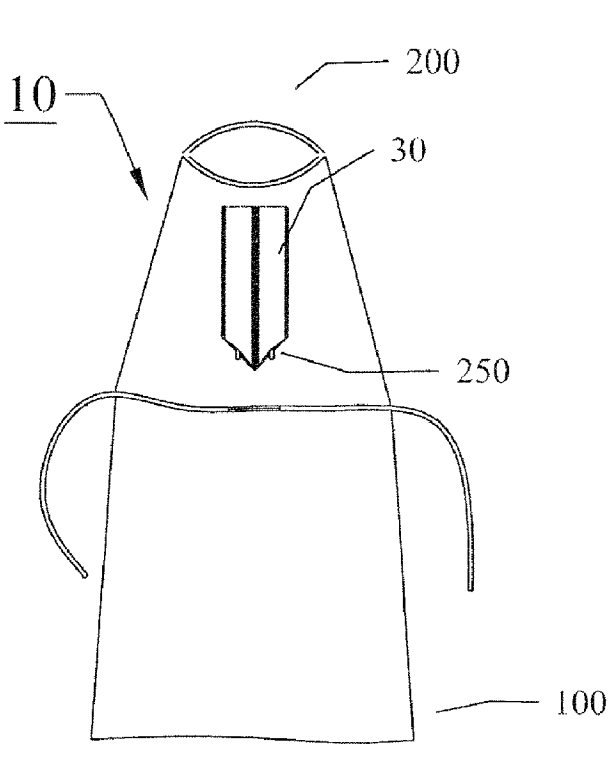
FIG. 11 illustrates a further alternative embodiment of a wearable protective barrier, which is an apron or similar style garment.

Many wearable, protective barrier garments, such as medical gowns, surgical gowns, aprons, vests, shirts, pants, and the like, can be manufactured as expandable one-size-fits-all products. Therefore, it is expected that wearers of various sizes can make use of such garments. FIGS. 1, 10A, and 11 illustrate examples of garment types that can be manufactured as one-size-fits-all products and can be also be utilized with the subject invention. Therefore, to accommodate the expected various sizes of wearer's hands, the covers 30 attached to such garment types can also be variable in size. In one embodiment, different sizes of covers can be removably affixed to a garment 20, allowing a wearer to use the one or more covers suitable or comfortable for their hand size, and/or an instrument. In this embodiment, a plurality of covers of different sizes can be removably affixed to the garment. In a further embodiment, the plurality of covers can be coded, for example by number, location, color, or other means that will inform a wearer of the size, so they can quickly use the appropriate size.

In an alternative embodiment, a cover 30 can have a one-size-fits-all configuration. FIGS. 2A-2B and 3A-3B illustrate embodiments comprising one or more pleats or folds that allow the cover 30 to be expanded to accommodate all or most wearers and hand-held instruments. As shown in FIGS. 2A, 2B, 3A and 3B, the covers 30 can have one or more lengthwise folds or pleats 33, extending from the closed end 150 of the cover to the open end 250 of the cover. This can allow the open edge 32 and interior 99 to be expanded as much as necessary to accommodate a wearer. Utilizing folds or pleats 33 can also reduce the overall dimensions of the cover prior to use, so that it covers less surface area on the gown. It can be advantageous for the pleats 33 to be directed towards the interior 99 of the cover, as shown, for example, in FIGS. 2A and 3A, so as to reduce the overall size and provide a compact cover requiring less surface area of the gown and less area required for attachment.

Another embodiment can have one or more crosswise folds or pleats 34 at one or more points along the length of a cover, such that the cover can be folded or pleated cross-wise to reduce the length prior to attachment to a gown 20. This can also compact the size of the cover and reduce the amount of surface area of the gown utilized to attach one or more covers. With this embodiment, the wearer can insert their hand into the open edge 32 of the cover 30 and pull or peel the cover to release one or more crosswise folds 34 to further insert their hand, or remove the entire cover from the gown before inserting their hand, or some combination thereof.

Figure 2C:
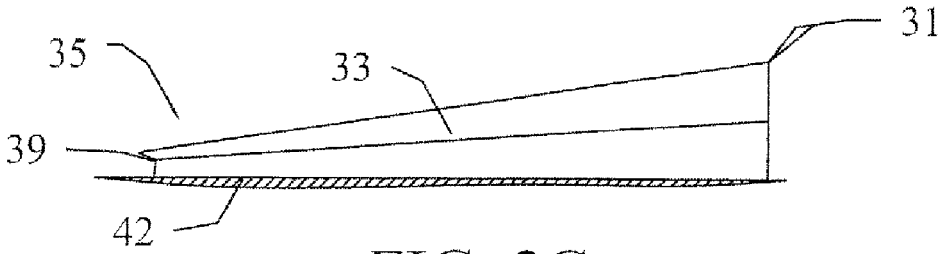

In yet another embodiment, the closed end 150 of a cover can have one or more end pleats 39 as well, to better accommodate a wearer's finger(s). FIG. 2C illustrates an embodiment having a closed end with an end pleat 39. It can be preferable for end pleats 39 to be directed towards the cover interior 99, again, to reduce the overall size of the cover attached to a gown 20.

To aid a wearer in inserting their hand into the open edge 32 of the cover and adjusting the cover around the hand and arm, one or more tabs 31 can be attached to, or formed as part of, the cover 30. Tabs can also be utilized for removing the covers from a hand and/or device. FIGS. 1, 2A, 2B, 3A, and 3B illustrate embodiments having at least one tab 31 at or near the open edge 32 of the cover. In these embodiments, at least one tab 31 is located at or near the open end and on the first side 11. In this way, while the cover is attached to the garment, the tab 31 can be pulled just enough to extend or widen the open edge 32 of the cover for easier insertion of a wearer's hand and/or an instrument into the interior 99 of the cover. Once the hand and/or device is adequately inserted, the wearer can then pull further to remove the cover from the garment. In further embodiments, additional tabs 31 can be located around the open end 250. In still further embodiments, there are one or more tabs 31 at various locations, such as on the first side 11 or the second side 12, on the cover to assist at any time with placement and/or adjustment of the hand and/or instrument therein, or to assist in removing the cover with minimal or no contamination of hands or instruments therein. In general, one or more tabs can be secured to any location on a cover that would be helpful to a user in inserting a hand, adjusting the cover on a hand, or removing the cover from a hand. In one embodiment, a tab is formed of a material that is different than the material(s) of the cover and is affixed to the cover. In another embodiment, a tab is formed as an extension of and is contiguous with the material(s) of the cover.

Figure 3C:
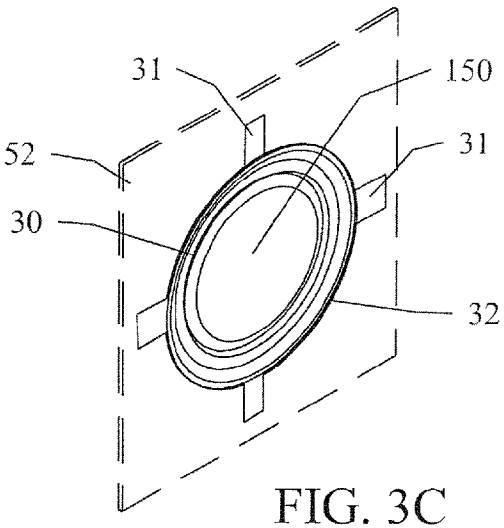
FIGS. 3A, 3B, 3C, and 3D illustrate alternative embodiments of the covers of the subject invention.

In a particular alternative embodiment, shown, for example, in FIG. 3C, a cover of the subject invention can be compressed lengthwise, that is from the closed end 150 to the open end 250, to form multiple folds or creases. This presents a cover 30 that is substantially flat, but with a fully or partially expanded open edge 32 and open end 250. In a further embodiment, one or more tabs are affixed to at least the open edge 32, possibly to other locations on the covers.

In a further embodiment, the closed end 150 side of a compressed cover can be removably attached to a support surface 52, as shown, for example, in dashed lines on FIG. 3C, such as a garment or disposable backing, as discussed below. To use a compressed cover, a person can place their finger tips against the side with the open end of the cover and, by utilizing tabs thereon, pull the open edge 32 to expand the cover over the hand and/or device. If the cover is affixed to a support surface, it can be removed or can fall away as the cover is pulled over the hand and/or device. In a further embodiment, one or more visual indicators can be utilized on the cover or the support surface to instruct the wearer how to place their hand relative to the compressed cover, so that it will be properly aligned when pulled with the tabs.

If a cover is utilized on each hand of a wearer, it can be problematic to remove them both without contaminating one or the other hand. Therefore, it can be beneficial to have one or more tabs on a cover that can remain sterile or uncontaminated to be used for remove a cover without contaminating an uncovered hand. In one embodiment, at least one tab 31 is located in an area of the cover that remains uncontaminated during a procedure. For example, at least one tab could be located on the first side 11 of the cover at or near the open edge. This can ensure that at least one tab is located a sufficient distance from the area(s) of possible contamination.

In an alternative embodiment, a cuff 43 is affixed on the exterior 98 of a cover and at least one tab 31A is located under the cuff 43, so that it is protected between the cuff 43 and the cover. In one embodiment, a cuff surrounds the open end of a cover. And, in a further embodiment, two or more tabs are located in different locations under the cuff. This allows a wearer to utilize tabs in different locations, if necessary, to remove the cover without risk of contaminating an uncovered hand.

In an alternative embodiment, a partial cuff is used around a section of the open end 250 of the cover. For example, a cuff 43 could be affixed to the first side 11 of the cover to protect at least one tab, as shown, for example, in FIG. 3A.

The pocket 89 formed between the cuff and the cover can be accessible from either the closed end 150 or the open end 250 of the cover. One example, shown in FIG. 3, has a cuff forming pocket 89 that opens towards the open end 250 of the cover. In use, a wearer can reach under the cuff, with a covered or, preferably, uncovered hand, and grasp a sterile or uncontaminated tab 31 and pull it towards the hand or device therein to remove the cover.

Figure 3D:
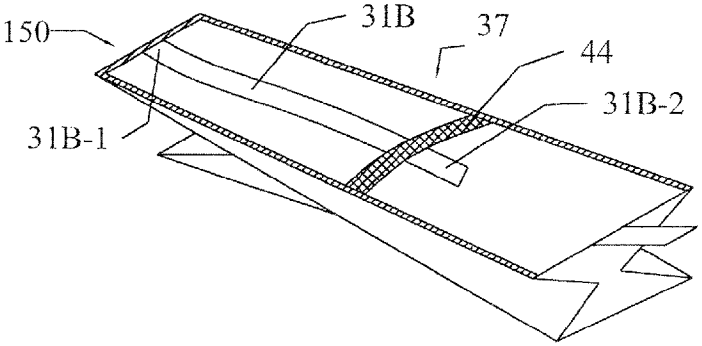
Figure 3A:
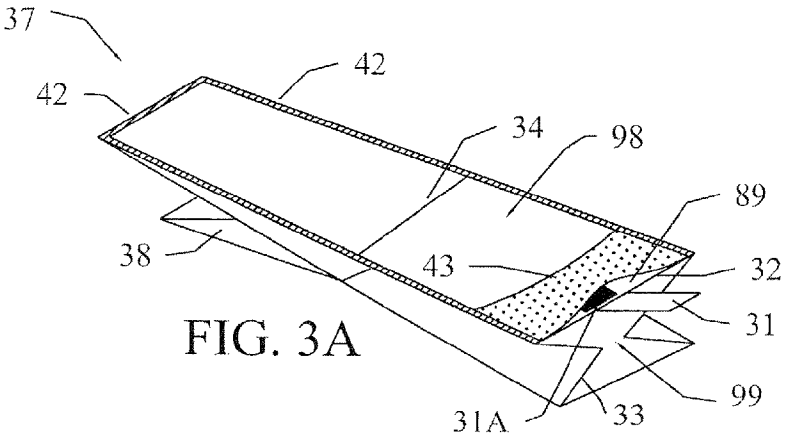
Figure 3B:
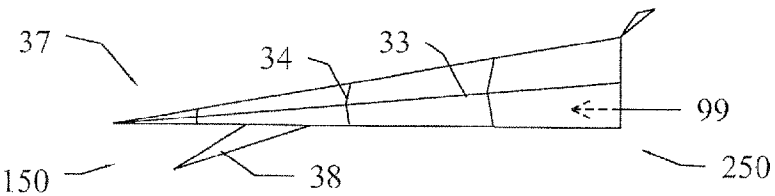

A still further alternative embodiment, shown, for example, in FIG. 3D, employs an elongated extension tab 31B having a first end 31B-1 fixedly attached to a point at or near the closed end 150 of the cover 30 and a second unaffixed end 31B-2. The length of the extension tab 31B can be between approximately ½ to approximately ⅔ the length of the cover. To secure the unaffixed second end 31B-2, a cross-band 44 can be employed that can have at least two ends affixed to the cover with a pre-defined unattached length there between. In a particular embodiment, the cross-band 44 is affixed by the at least two ends to the first side 11 of the cover 30. The unaffixed second end 31B-2 can be positioned against the first side 11 of the cover and between the affixed ends of the cross-band to removably secure the second end 31B-2 against the exterior of the cover. A cross-band 44 can be of any width necessary to secure the unaffixed second end 31B-2. The cross-band can extend across or partially across a cover, such as, on the first side 11. In one embodiment, a cross-band 44 extends fully across the width of the first side 11, as shown, for example, in FIG. 3C. In another embodiment, a cross-band 44 can be a shorter width, sufficient to secure the second end 31B-2, but only extending partially across the first side 11.

In use, the second end 31B-2 of the extension 31B is held against the exterior of the cover, such as, the first side 11, by positioning it under the cross-band 44 between the two affixed ends. When desired to remove the cover, the extension 31B can be grasped and pulled to free the second end from under the cross-band and pulled towards the closed end of the cover to pull the cover from the hand.

In an alternative embodiment, all or some portion of the extension 31B, such as for example, the second end 31B-2 or some portion of the length of the extension tab, can be removably attached to the first side 11 of the cover utilizing any of a multitude of techniques known in the art, such as, for example, heat sealing, cold sealing, embossing, sonic bonding, adhesives, etc, as will be described in detail below. To utilize the extension tab 31B, the affixed portion can be pulled to separate it from the cover exterior and pulled towards the closed end of the cover to remove the cover from the hand, as described above.

Another embodiment of a cover can comprise one or more securing structures 40 that can aid in holding the cover onto a hand. Thus, a cover can further comprise, by way of non-limiting examples, one or more elastic bands, wrap-around bands, expandable puckers or pleats, pull ties, cuffs, crepe material, or other structures or materials that are in, on, or around some portion of the cover that can constrict the cover's open end 250 around a wearer's wrist and/or arm to maintain the position of the cover. The securing structures 40 can be around the open edge 32 of a cover, or positioned nearer to the closed end 150 of a cover, or be located anywhere between the open end 250 of the cover or the closed end 150 of the cover. FIG. 2A illustrates an embodiment wherein the fabric on the first side 11 has a plurality of puckers or small pleats as securing structures 40 that provide some elasticity around the wrist or forearm to hold the cover in place. A person with skill in the art would be able to determine any of a variety of devices and methods that could be used to maintain the position of a cover on a wearer's arm.

Embodiments of the covers 30 described herein can be quick and easy to use. It further is anticipated that the shapes disclosed would allow them to be removably affixed to a medical gown or other garment. Further embodiments can comprise more shape conforming designs or configurations specific for various instruments. For example, in one embodiment, the covers can be more glove-shaped to better conform to a wearer's hand and fingers. Alternatively, a cover can be configured to accommodate a specific instrument or device, such as a stethoscope, thermometer or reflex hammer. Thus, a variety of cover configurations could be utilized with the subject invention and such modifications and variations are considered to be within the purview of the subject application.

As mentioned above, the subject invention pertains to covers 30 that are removably attached to a garment, such as, for example, a gown, apron, bib, shirt, or other garment capable of covering a least a portion of the chest or other frontal area of a wearer. In an alternative embodiment, the garment of the subject invention can be pants or similar leg-coverings to which covers of the subject invention can be attached. In one embodiment, the garment is any wearable item capable of covering and/or protecting at least a portion of the front side of a wearer. Advantageously, the covers being integrated with a garment, as in embodiments of the subject invention, can be easy to find, easy to put on a person or medical device, and easy to remove from the garment. The covers can be removably affixed to a garment at almost any location on the garment that will permit a user to insert their hand and, perhaps, at least a portion of their forearm. In one embodiment, the covers can be put on after a wearer has donned the garment 20 to which the covers are attached. This can assist in maintaining sterility of the garment and the covers, if necessary. Alternative embodiments can include covers that are attached to the garment in a fashion such that they can be put on, or removed and put on, prior to donning the garment.

The features and characteristics of the covers of the subject invention make them advantageous even apart from being conveniently attached to a garment. Thus, in an alternative embodiment, the covers of the subject invention are separate and apart from any type of garment, such that they can be utilized without the necessity of donning and/or removing the covers from a garment. In one embodiment, a plurality of covers of the subject invention is arranged in a dispenser that facilitates removing them one or more at a time for use. In an alternative embodiment, the covers are individually packaged for use. In a still further embodiment, one or more covers can be arranged in a transportable package that can be kept in a pocket or transported with various equipment or carts. In a particular embodiment, the covers can be removably affixed to a disposable backing or card 52. The covers can be removably attached, so that one side lies flat against the card, or, for a more compact package, a cover can be configured with multiple folds or creases that can be expanded as the cover is removed from the backing. For example, as described above, a cover can be compressed lengthwise and removably secured to a backing. This allows a person to place the finger tips against the card within the exposed open end of the cover and, utilizing tabs thereon, pull expand the cover over the hand which simultaneously removes the cover from the card.

In a yet further embodiment, a permanent dispenser, such as, for example, a wall mounted apparatus, is utilized from which a plurality of covers can be dispensed and replaced as necessary. A person with skill in the art would be able to devise any of a variety of disposable or non-disposable dispensers that could be used with embodiments of the covers of the subject invention.

The attachment of the covers to a garment can be achieved by numerous methods known in the art. It is anticipated that the garments and covers of the subject invention can be disposable, or single-use. But, other embodiments can comprise reusable garments and covers. For example, in one embodiment, the covers 30 can be removably attached using any of a variety of adhesives or fixatives, such as for example, glue, cements, and double-sided tapes, that will hold the covers in place, but allow them to be removed relatively easily from the garment when necessary. In a further embodiment, the covers do not have a sticky residue after being removed from the garment. Thus, the adhesive or fixative should not come off with or otherwise remain attached to a cover after it is removed from the garment. In another embodiment, the adhesive or fixative should not remain sticky or tacky after removal of a cover.

In an alternative embodiment, the covers can be attached to the garment utilizing various devices, which are known in the art, such as, for example, snaps, hook and loop material, zipper seal stripping, releasable stitching, or other mechanical attachment means. In this embodiment, the covers can be reusable and can be reattached to a garment, for example after cleaning or sterilizing the covers.

In a further alternative embodiment, a cover of the subject invention can be attached by employing devices or techniques that allow for one-time attachment and/or detachment of a cover to a garment. For example, a cover of the subject invention can be cold-sealed and/or crimp-sealed to a garment. In a further embodiment, any of a variety of high-pressure indentation or embossing techniques could be used, as known to those with skill in the art. In this embodiment, all or some portion of a cover, such as, for example, the edges of the cover, can be attached to the material of the garment by applying high pressure to form indentations or embossing that join or intertwine the fibers and/or materials of a garment and/or cover. In a further embodiment, such high-pressure embossing or indentation techniques can be used in conjunction with an adhesive. A person with skill in the art and benefit of the subject disclosure would be able to determine any of various methods and devices that could be used to cold-seal, crimp-seal, or pressure-seal a cover to a garment of the subject invention, and such variations are contemplated to be within the scope of the subject invention.

In a still further alternative embodiment, the covers can be removably attached by employing heat sealing or sonic bonding technologies. In this embodiment, the garment 20 and/or the cover 30 can comprise one or more heat sensitive or sonic bondable materials, such as, for example, nylons, rayon, Lycra, acrylic, polyesters, polymers, and other materials, that, when heated or sonicated, can form a temporary seal or attachment between the garment and the cover.

In one embodiment, the garment and covers, or some portion thereof, can comprise materials formed from non-woven polyvinylpropylene, polyethylene, or polyvinylpyrolidene, commonly used to manufacture medical gowns and other garments, such as, for example, disposable medical gowns. In this embodiment, the covers 30 can be releasably affixed to the garment by heat pressing or sonic bonding the cover to the garment such that some portion of the fibers of each form a removable attachment. In a further embodiment, at least one outside edge of a cover 30 can be heat pressed or sonicated to the garment to form a temporary heat seal 42. FIGS. 1, 2A, 3A, and 4 illustrate embodiments wherein at least one outside edge of a cover has been attached to a garment with a heat seal 42. Again, a person with skill in the art would be able to devise any number of techniques and devices for forming a temporary, removable heat seal, heat pressing, or sonic bond between the cover and the garment of the subject invention and such variations are considered to be within the scope of the subject invention.

There are a variety of devices and methods known in the art that can be used to temporarily, removably affix a cover of the subject invention to a garment. The device or method utilized will depend upon the type of material(s) used for the cover and/or garment, the intended use of the cover and garment, whether it is intended to be disposable or reusable, and other factors that would be known to a person with skill in the art. In general, any device, method, technique or procedure that can removably affix a cover of the subject invention to a garment, such that the cover can be removed from the garment by peeling, pulling, twisting, or some combination thereof, is considered to be within the scope of the subject invention.

In some embodiments of the subject invention, sterility of the garment and/or covers can be a factor. Therefore, the articles of the subject invention can comprise one or more materials capable of being sterilized. In further embodiments, the articles of the subject invention can comprise one or more materials that can prevent passage of microbes, chemicals, gases, or other undesirable products. In a further embodiment, any of a variety of antimicrobial agents can be incorporated with the articles of the subject invention, to further aid in maintaining the sterility of the garment, covers, hands and/or devices in the cover. Alternatively, such antimicrobial agents are on the exterior 13 or are externally accessible or releasable, so that contact with devices on the outside of the covers or the garment causes their release. In a particular embodiment, a plurality of microspheres that contain or have embedded any of a variety of anti-microbial substances can be incorporated into materials of the covers of the subject invention. In this embodiment, when the cover comes into contact with another surface, the microspheres are caused to release the anti-microbial, thus maintaining the sterile or substantially sterile surface of the cover, and simultaneously the contacted surface. A person with skill in the art would be familiar with any of a variety of biocompatible substances and methods of release, such as various types and sizes of microspheres, that could be utilized with the subject invention.

In one embodiment, such products are incorporated or impregnated into the material of a garment and/or cover, such that they are released upon contact with the exterior 13 of said material. In an alternative embodiment, antimicrobial agents are enclosed within a cover and released or accessed after a hand and/or device is inserted therein. In another alternative embodiment, antimicrobial agents are contained between the second side 12 of a cover and a garment to which it is attached, such that removal of the cover from a garment releases or otherwise makes accessible the antimicrobial agent.

Figure 4:
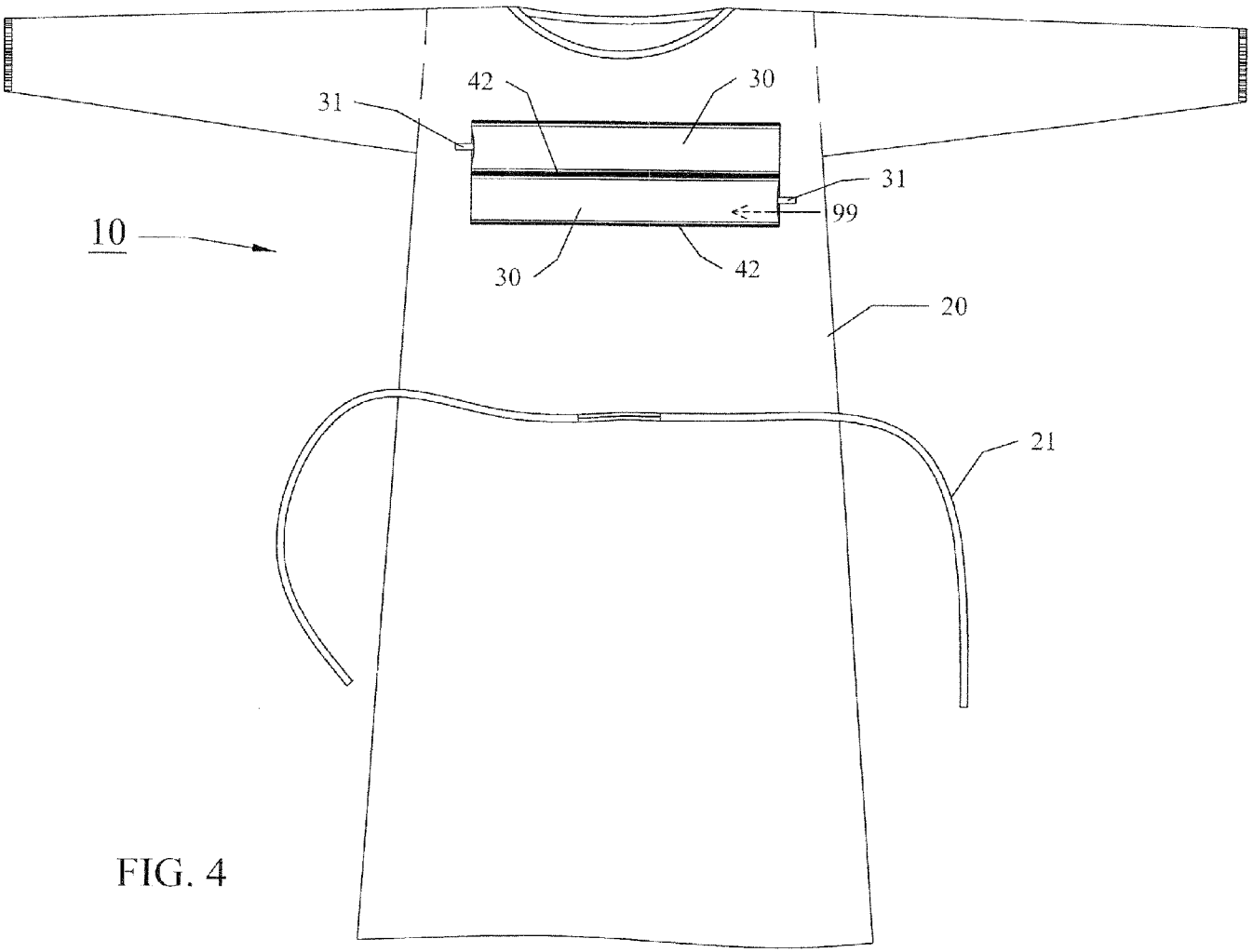
FIG. 4 illustrates another embodiment of the wearable protective barrier of the subject invention. In this embodiment, a garment can be configured with two removable covers attached horizontally to the chest area, so that the covers open in generally opposite left and right directions.
Figure 6:
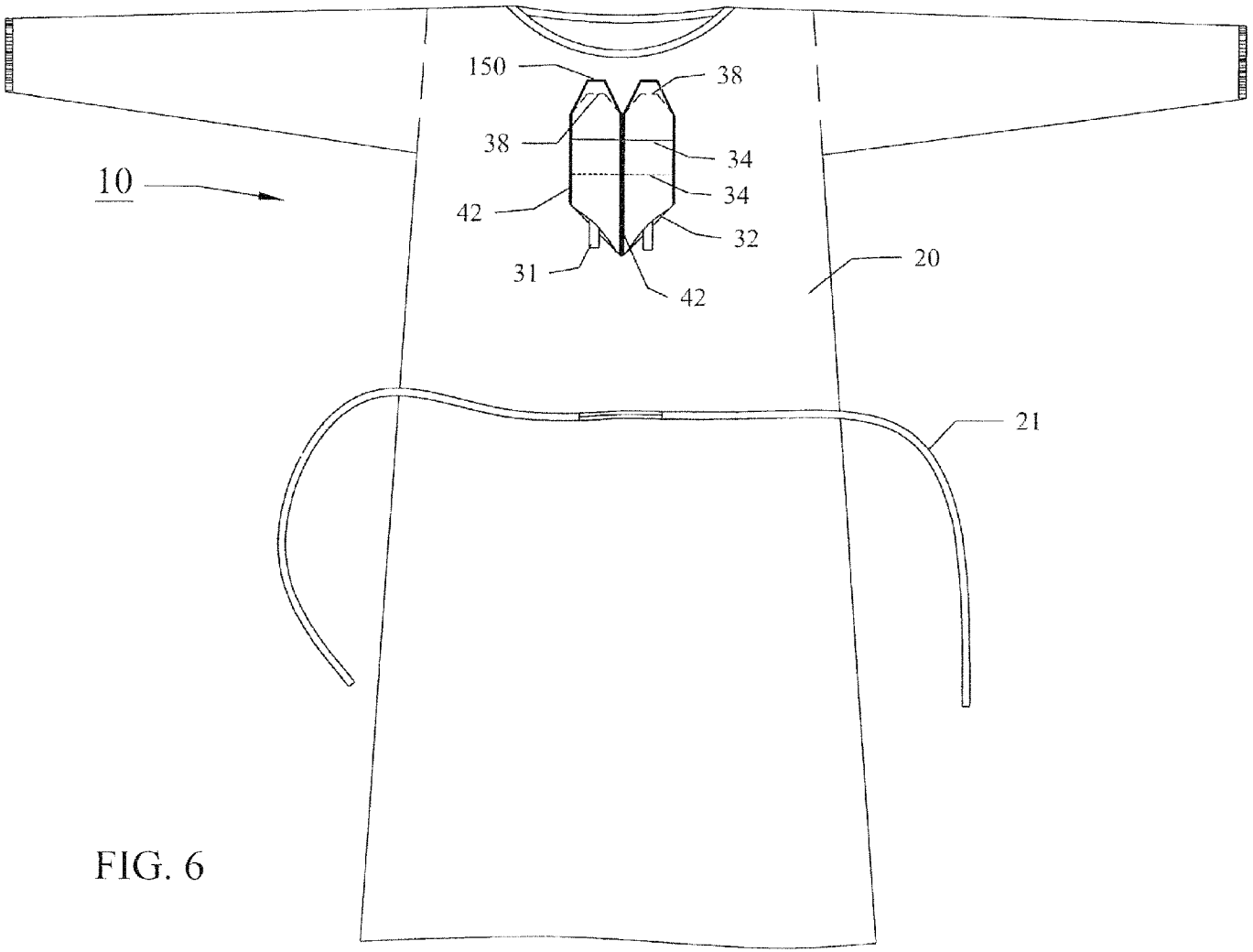
FIG. 6 illustrates another embodiment of the wearable protective barrier of the subject invention, wherein a garment can be configured with two removable covers that are attached vertically to the chest area, such that the open end is directed towards the bottom of the garment. Also shown are covers with thumb compartments and tapered ends.

The location of attachment of the covers to the garment can depend upon several factors, including, but not limited to, the type or style of the garment, whether the garment will be donned prior to removal of the covers, the number of covers to be attached to the garment, the expected flexibility of the wearer and their ability to remove covers located in certain positions, the configuration and dimensions of the cover, referred to as a "footprint", that will be attached to the garment, as well as other factors that would be understood by those skilled in the art. In one embodiment, at least one cover can be attached to a garment. Alternative embodiments can have at least two covers attached to a garment, for example, as shown in FIGS. 1, 4, and 6. Further alternative embodiments can have multiple removable covers attached to a garment.

It is expected that for most uses a garment of the subject invention will be donned prior to removal of a cover. Thus, it can be preferable for the covers to be attached to the outside of the garment. One embodiment, shown for example, in FIG.

Figure 5:
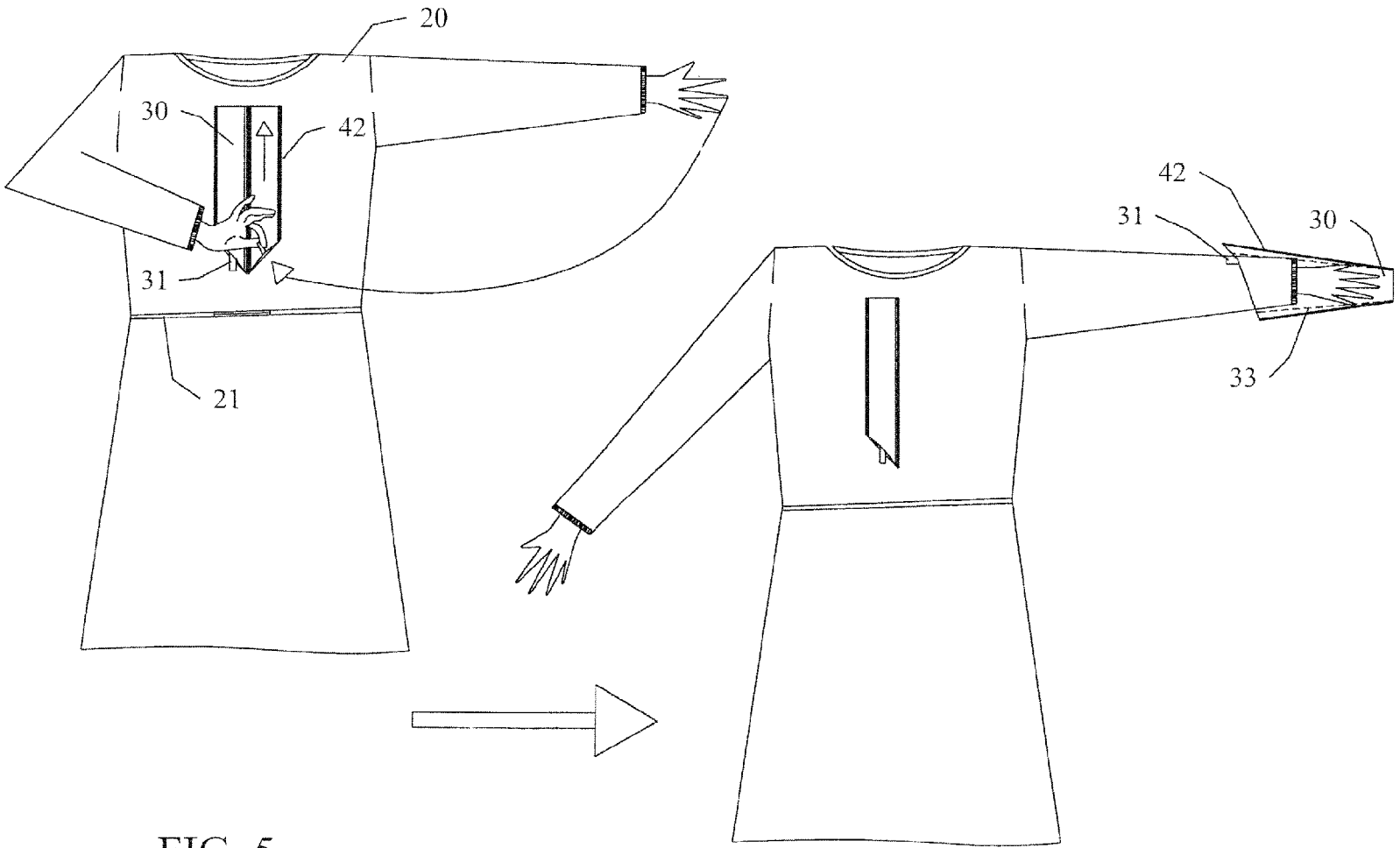
FIG. 5 illustrates a method of putting a cover of the subject invention on a hand and removing it from a garment.

1, employs covers attached to the front torso or chest area of the garment. In this embodiment, a cover can be oriented in a generally vertical configuration where the closed end 150 is directed, in general, towards the top end 200 of the garment and the open end 250 of a cover is directed, in general, towards to the bottom end 100 of the garment. This embodiment can allow the wearer to insert a hand into the open end 250 of the cover, located at or near the waist of the garment 20, and extend the hand, while inside the cover 30, upwards, towards the head, as shown in FIG. 5. The one or more tabs 31 around the open end 250 can be used to widen the open end for easier insertion of a hand and/or instrument. As the hand is pushed into the cover, the one or more pleats 33 and 39 expand as necessary, allowing the interior 99 to accommodate the size of the wearer's hand. Once a hand is positioned within the cover, or simultaneously while pushing the hand upwards, the cover can be pulled or peeled off the garment. This can be made easier if the garment is secured at the waist, such as, for example, with one or more ties or wraps that span the waist of the wearer. Medical gowns and other such garments often have ties 21 that can be used to secure the garment. Alternatively, a wearer can hold or secure the garment to hinder movement, for example, by pressing one arm or hand against the side or front of the garment, while the second hand is detaching a cover.

The one or more tabs 31 around the open edge 32 or at other locations on the cover 30 can be used to further adjust the cover on the hand and/or forearm and around an instrument. The tabs can be particularly helpful if the covers have crosswise folds 34, which can, but not always, necessitate that the cover be partially or entirely removed from the garment prior to a hand being fully inserted into the cover. Any securing structures 40 present on the cover will help to hold it in the desired position and the cover can be adjusted using one or more tabs 31.

An alternative embodiment, an example of which is shown in FIG. 4, employs covers applied to the gown in a horizontal fashion. In this embodiment, the open ends 250 of each cover 30 can be positioned directly opposite one another, permitting a wearer to more conveniently insert each hand into a cover. A wearer can insert their right or left hand into the open end of an appropriately placed cover and move their hand towards the left or right side, respectively. As described previously, as the wearer inserts their hand, the one or more pleats will expand to accommodate the size of the wearer's hand. Once a band is adequately inserted, the cover can be peeled or pulled off of the garment. One or more tabs on the cover can be used to widen the open end or open edge and/or adjust the cover on the hand and/or forearm. Any securing structures 40 present on the cover will help to hold it in position on the hand or arm.

A further alternative embodiment, shown, for example, in FIG. 6, utilizes covers attached to a garment in a vertical position, with crosswise pleats 34, tapered closed ends 150, and a thumb compartment 38, located between the cover and the garment, as shown. In this embodiment, a wearer can insert a hand into a cover, as described above, until it reaches a crosswise pleat 34. The one or more crosswise pleats 34 can be unfolded as the cover is pulled away from the garment allowing the hand can be inserted further. As before, once the hand is inserted, or simultaneously with insertion, the cover can be pulled, peeled, twisted, or some combination thereof to remove it from the garment. One or more tabs can be used to adjust or position the cover and any securing structures 40 can aid in holding it in place.

Figure 7:
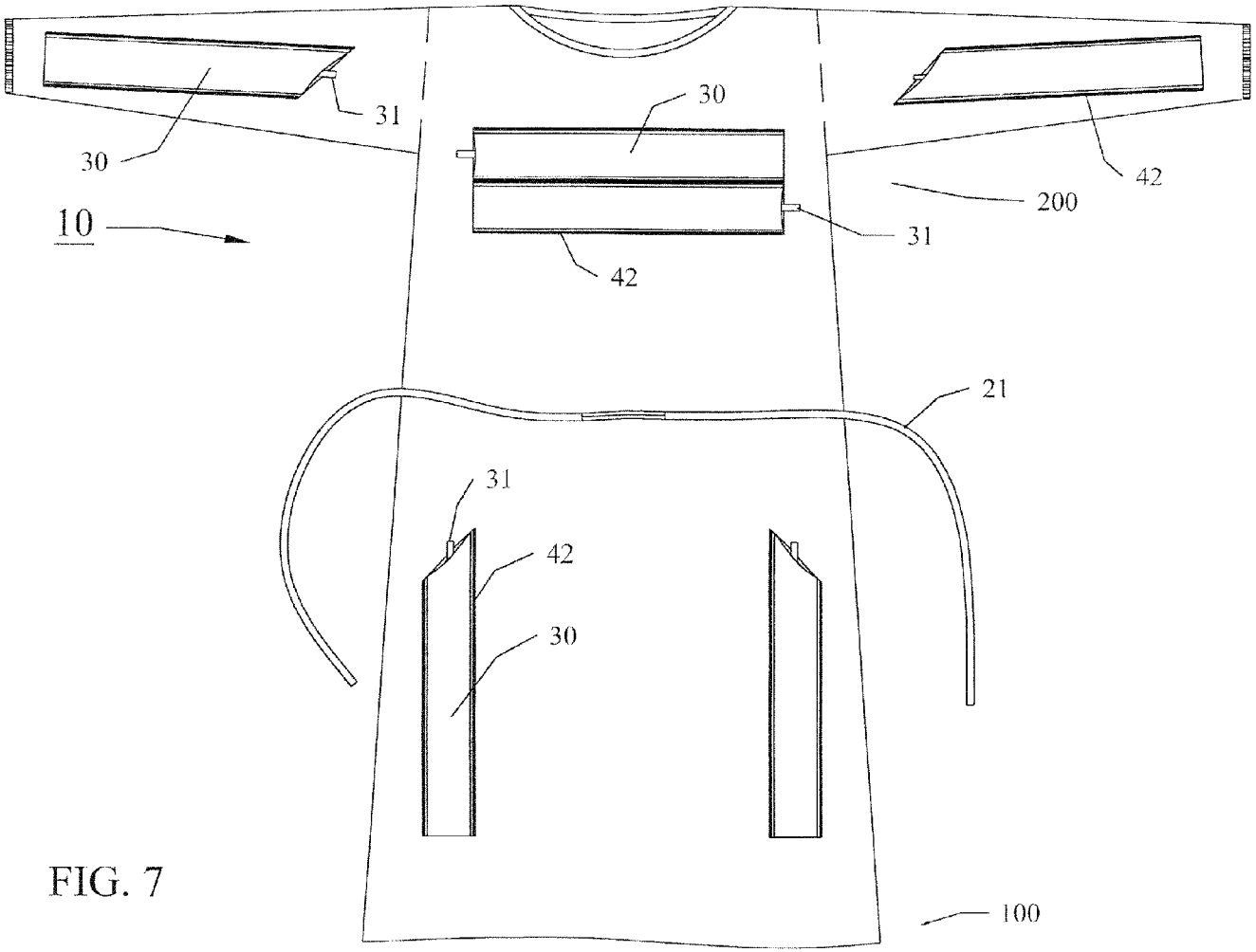
FIG. 7 illustrates another embodiment of a wearable protective barrier of the subject invention, wherein a garment can be configured with removable covers attached to the sleeves and skirt area of the garment.

In certain situations, it can be helpful to have more than just two covers available. If one or both of them become soiled or contaminated during a procedure, having additional covers available and easy to use would be more convenient than having to obtain additional covers or gloves to replace the soiled or contaminated one. It may also be helpful to locate covers in alternative positions to those described above. FIG. 7 shows examples of several sets of covers affixed to a garment in locations other than the torso or chest area. The locations on the garment can include the sleeves and/or skirt region. These can be alternative locations for covers on garments, or they could be additional locations for additional or back-up sets of covers.

Figure 8:
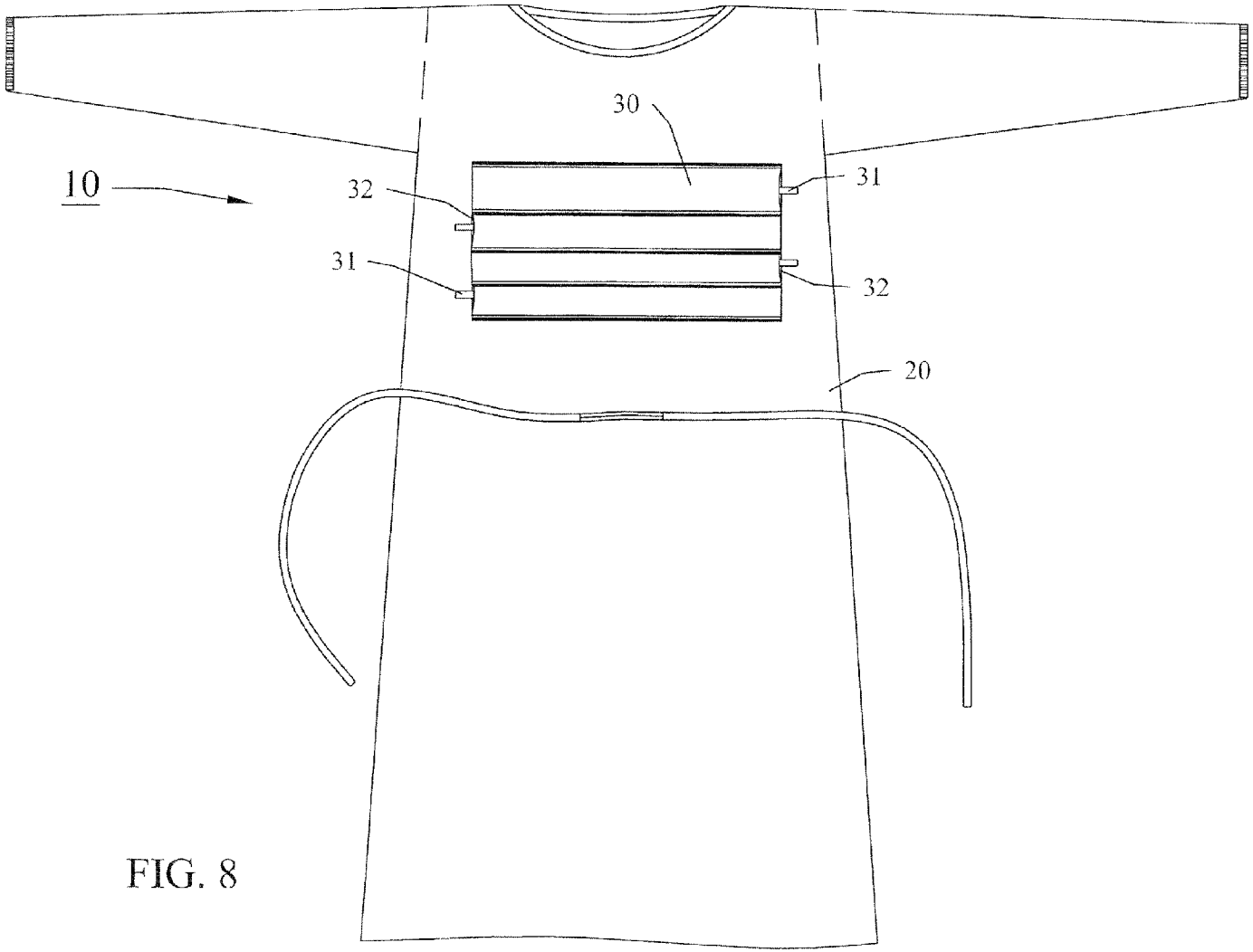
FIG. 8 illustrates an embodiment of a wearable protective barrier of the subject invention wherein a garment can be configured with multiple covers removably attached to the chest area in an overlapping horizontal configuration.

Conversely, it may be convenient to have more than one set of covers located on the garment. FIG. 8 shows an alternative embodiment having more than one set of covers arranged in an overlapping fashion on the chest area of the garment. In this embodiment, the edge nearest the top of the gown 200 and the edge along the closed end 150 of each cover can be affixed to the garment. However, alternative embodiments may affix just one edge or some other section of the cover to the garment. In a further embodiment, the upper most covers can be arranged so as to overlap the lower ones, as seen in FIG. 8, for example. Thus, with this embodiment, the covers at the top end 200 can be removed first from the garment allowing the next lower one to be opened and used. In this embodiment, several covers could be removably affixed to a garment allowing a wearer to repeatedly change covers without having to change garments.

As mentioned above, the subject invention can include pants or a pants-like garment 60 capable of protecting all or some of the legs of a wearer. In this embodiment, one or more covers 30 can be removably attached, as detailed above, to the pants 60 in a variety of configurations and to any part of the pants that will allow a wearer to utilize the covers, in similar fashion as described in previous embodiments. In one embodiment, the covers are removed before the pants are worn. In an alternative embodiment, the pants are donned by a wearer before removing the covers. Therefore, the position of the covers will depend upon several factors, including whether they will be worn before or after the covers are removed, and any variations in location are deemed to be within the scope of the subject invention.

In one embodiment, one or more covers, as described above, can be attached to the front leg area 62 of the pants, as shown in FIG. 10A. In a specific embodiment, one or more covers can be attached to the front leg area 62 generally above where the knee of a wearer would be located. In a further embodiment, the open end 250 of the cover(s) can be oriented, in general, towards the head of a person that would be wearing the pants. In an alternative embodiment, one or more covers can be attached having the open end 250 oriented, in general, towards the left or right side of a person that would be wearing the pants.

In an alternative embodiment, one or more covers 30 can be attached along one or both sides of the pants legs, for example, as shown in FIG. 10B. In a further alternative embodiment, one or more covers can be attached above the general knee area of the pants, as shown. In a still further embodiment, the open end 250 of one or more covers can be oriented, in general, towards the head of the wearer. In an alternative embodiment, the open end of one or more covers can be oriented, in general, towards the back of a wearer. And, in a still further embodiment, the open end of one or more covers can be oriented, in general, towards the front of a wearer.

In a further alternative embodiment, one or more covers can be removably affixed to the front area of the pants. More specifically, one or more covers can be removably affixed above the legs and below the waist. In one embodiment, the open end 250 of one or more covers can be oriented generally towards the head of a wearer. In an alternative embodiment, the open end 250 of one or more covers can be oriented generally towards the side(s) of the wearer. An alternative embodiment can utilize covers that have two or more crosswise folds 34, so as to shorten the overall length and provide a more compact cover to be affixed to a garment. In this embodiment, two, four, or more covers can be placed side by side and/or one above the other, without overlapping.

Situations may also arise that require a doctor, nurse or other professional to temporarily cover or protect their hands, not for use, but in order to move from one location to another without contamination either to, or from, their hands. For example, a doctor in a sterile environment, may need to temporarily step out of the room for any number of reasons, e.g., to confer with other professionals or family members of a patient; to consult charts, files, or other records; to move through a non-sterile environment to another sterile one; or other similar situations. But, to return to a sterile environment, the hands must also be kept sterile or must be re-sterilized before returning to the sterile environment.

Therefore, another embodiment of the subject invention is a two-hand cover 50 that permits one more hands and/or instruments, to be inserted, for example, one at each end. FIG. 9 shows an example of a two-hand cover 50 having a generally tubular shape when expanded, where a hand can be inserted at each end. With this embodiment, the hands and/or instrument can be inserted into the sterile interior 99 prior to leaving a sterile environment. In a further embodiment, each end can have at least one tab 31 that can be used to widen the open edge and aid in hand insertion. In a still further embodiment, there can be one or more securing structures 40 to aid in holding the cover 50 over the hands and forearms. With this embodiment, the hands are not necessarily protected for use, but more to maintain their sterility while outside a sterile environment. And, in a still further embodiment, the interior 99 can comprise any of a variety of antimicrobial agents, substances, or materials, as described previously, to further aid in maintaining the sterility of the hands while in the cover. A person with skill in the art would be familiar with any of a variety of biocompatible substances that could be utilized in the cover to maintain sterility.

The subject invention describes with sufficient detail embodiments of a protective hand and/or device cover that can be removably attached to a variety of garment styles. The articles and methods of the subject invention are a convenient means for making such covers immediately accessible and convenient to use. However, the covers of the subject invention, even without being attached to a garment, have a variety of advantageous features. Thus, the covers of the subject invention can be useful separate and apart from a garment.

In one embodiment, a plurality of covers of the subject invention can be packaged in a dispenser from which one or more can be removed as needed. In an alternative embodiment, covers of the subject invention can be packaged singly or in multiples. A person with skill in the art and knowledge of the subject invention would be able to create alternative means for dispensing and using the covers of the subject invention. Such alternatives are considered to be with the purview of the subject invention.

All patents, patent applications, provisional applications, and publications referred to or cited herein are incorporated by reference in their entirety, including all figures and tables, to the extent they are not inconsistent with the explicit teachings of this specification.

It should be understood that any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. Further, when a particular feature, structure, or characteristic is described in connection with any embodiment, it is submitted that it is within the purview of one skilled in the art to affect such feature, structure, or characteristic in connection with other ones of the embodiments.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures, can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

I claim:

1. A garment capable of protecting some portion of at least the front side of a wearer, said garment having at least one cover comprising a sheath with a closed end and an open end, an interior for containing and protecting a hand and/or device, and at least one lengthwise pleat extending from the open end to the closed end for compressing the cover against the garment and allowing expansion when a hand and/or device is inserted therein wherein at least a portion of the outside edge of the at least one cover is removably attached directly to the garment allowing said cover to be permanently detachable from the garment prior to being used.

2. A garment, according to claim 1, selected from the group consisting of gowns, shirts, dresses, aprons, bibs, bandoliers, suspenders, vests, pants, chaps, and leg clothing.

3. The garment, according to claim 1, wherein the at least one cover further comprises at least one tab for use in expanding the lengthwise pleat at or near the open end for inserting a hand and/or device.

4. The garment, according to claim 3, wherein the at least one tab is fixedly attached at or near the open end of the cover.

5. The garment, according to claim 1, wherein the at least one cover further comprises one or more crosswise folds.

6. The garment, according to claim 1, further comprising one or more structures for constricting the open end of the at least one cover, so as to secure the at least one cover to the hand and/or device therein.

7. The garment, according to claim 1, wherein at least a portion of the cover comprises a material capable of being at least partially conformed to the shape of a hand or device after insertion within the cover.

8. The garment, according to claim 1, wherein the cover is tapered towards the closed end.

9. The garment, according to claim 1, wherein one or more heat seals are utilized to removably attach at least a portion of the outside edge of the cover to the garment.

10. The garment, according to claim 1, wherein one or more high-pressure indentations or embossing seals are utilized to removably attach at least a portion of the outside edge of the cover to the garment.

11. The garment, according to claim 1, wherein the portion of the outside edge of the at least one cover is removably attached to the garment utilizing a device selected from the group consisting of snaps, breakable stitching, hook and loop material, and zipper seal stripping.

12. The garment, according to claim 1, wherein the portion of the outside edge of the at least one cover is removably attached utilizing at least one adhesive material.

13. The garment, according to claim 1, wherein the closed end of the at least one cover is directed towards a top end of the garment and the open end is directed towards a bottom end of the garment.

14. The garment, according to claim 1, further comprising a sterilizing agent within the interior of the at least one cover.

15. The garment, according to claim 1, further comprising a sterilizing agent on the exterior of the at least one cover.

16. The garment, according to claim 15, wherein the sterilizing agent is located on a portion of the at least one cover for contacting with a surface or a patient.

17. The garment, according to claim 1, wherein the at least one cover is removably adhered to the torso of the garment.

18. The garment, according to claim 1, wherein the at least one cover is compressed against the garment to present a substantially flat profile prior to use.

19. The garment, according to claim 6, wherein the structures comprise one or more of elastic bands, wrap around bands, expandable puckers or pleats, pull ties, cuffs, or a crepe, crepe-like or similarly crinkled material.

20. The garment, according to claim 7, comprising a crepe, crepe-like, or similarly crinkled material that can be at least partially molded to the shape of the hand and/or device therein.

21. The garment, according to claim 1, wherein the closed end of the at least one cover has a shape that facilitates insertion of a hand and/or device.

22. The garment, according to claim 1, comprising two or more covers.

23. The garment, according to claim 22, wherein the two or more covers are of different sizes.

24. The garment, according to claim 1, further comprising at least one end pleat that extends at least partially across the closed end of the cover.

25. A garment capable of protecting some portion of at least the front side of a wearer, said garment having at least one cover comprising a sheath with a closed end and an open end, a first side and a second side, an interior for containing and protecting a hand and/or device, and at least one pleat extending from the open end to the closed end for compressing the cover against the garment and allowing expansion when a hand and/or device is inserted therein, wherein the second side of the cover is removably adhered directly to the garment, such that the cover can be permanently detached from the garment.

26. A garment, according to claim 25, selected from the group consisting of gowns, shirts, dresses, aprons, bibs, bandoliers, suspenders, vests, pants, chaps, and leg clothing.

27. The garment, according to claim 25, wherein the at least one cover further comprises at least one tab for use in expanding the pleat near the open end for inserting a hand and/or device.

28. The garment, according to claim 27, wherein the at least one tab is fixedly attached at or near the open edge of the cover.

29. The garment, according to claim 25, wherein the at least one cover further comprises one or more crosswise folds.

30. The garment, according to claim 25, further comprising one or more structures for constricting the open end of the at least one cover, so as to secure the at least one cover to the hand and/or device therein.

31. The garment, according to claim 25, wherein at least a portion of the cover comprises a material capable of being at least partially conformed to the shape of a hand or device within the cover.

32. The garment, according to claim 25, wherein the cover is tapered towards the closed end.

33. The garment, according to claim 25, wherein one or more heat seals are utilized to removably adhere the second side of the cover to the garment.

34. The garment, according to claim 25, wherein one or more high-pressure indentations or embossing seals are utilized to removably adhere the second side of the cover to the garment.

35. The garment, according to claim 25, wherein the second side of the at least one cover is removably adhered to the garment utilizing a device selected from the group consisting of snaps, breakable stitching, hook and loop material, and zipper seal stripping.

36. The garment, according to claim 25, wherein the second side of the at least one cover is removably attached utilizing at least one adhesive material.

37. The garment, according to claim 25, wherein the closed end of the at least one cover is directed towards a top end of the garment and the open end is directed towards a bottom end of the garment.

38. The garment, according to claim 25, further comprising a sterilizing agent within the interior of the at least one cover.

39. The garment, according to claim 25, further comprising a sterilizing agent on the exterior of the at least one cover.

40. The garment, according to claim 39, wherein the sterilizing agent is located on a portion of the at least one cover for contacting with a surface or a patient.

41. The garment, according to claim 25, wherein the at least one cover is removably adhered to the torso of the garment.

42. The garment, according to claim 25, wherein the at least one cover is compressed against the garment to present a substantially flat profile prior to use.

43. The garment, according to claim 30, wherein the structures comprise one or more of elastic bands, wrap around bands, expandable puckers or pleats, pull ties, cuffs, or a crepe, crepe-like or similarly crinkled material.

44. The garment, according to claim 31, comprising a crepe, crepe-like, or similarly crinkled material that can be at least partially molded to the shape of the hand and/or device therein.

45. The garment, according to claim 25, wherein the closed end of the at least one cover has a shape that facilitates insertion of a hand and/or device.

46. The garment, according to claim 1, comprising two or more covers.

47. The garment, according to claim 25, further comprising at least one end pleat that extends at least partially across the closed end of the cover.

* * * * *